US006837373B2

(12) United States Patent
Huang

(10) Patent No.: US 6,837,373 B2
(45) Date of Patent: Jan. 4, 2005

(54) TOOL SUSPENSION DEVICE WITH A BURGLARPROOF FEATURE

(76) Inventor: Hsin-Te Huang, No. 11, 35 Rd., Ind. Dist., Taichung (TW)

( * ) Notice: Subject to any disclaimer, the term of this patent is extended or adjusted under 35 U.S.C. 154(b) by 0 days.

(21) Appl. No.: 10/378,358

(22) Filed: Mar. 3, 2003

(65) Prior Publication Data

US 2004/0173485 A1 Sep. 9, 2004

(51) Int. Cl.[7] ..... B65D 85/28
(52) U.S. Cl. ..... 206/376; 206/480; 206/806
(58) Field of Search ..... 206/376, 372, 206/373, 349, 477, 480–482, 806; 211/60.1, 70.6, 89.01; 248/309.1, 222.11, 222.12

(56) References Cited

U.S. PATENT DOCUMENTS 5,906,350 A * 5/1999 Kao ..... 248/688
5,996,817 A * 12/1999 Kao ..... 211/70.6
6,076,669 A * 6/2000 Ling ..... 206/349
6,186,323 B1 * 2/2001 Jansson et al. ..... 206/349
6,241,208 B1 * 6/2001 Lin ..... 248/309.1
6,378,700 B1 * 4/2002 Tong ..... 206/376
6,401,923 B1 * 6/2002 Huang ..... 206/376
6,536,611 B2 * 3/2003 Chen ..... 211/70.6
6,578,711 B1 * 6/2003 Chou ..... 206/467
6,637,591 B2 * 10/2003 Chen ..... 206/349
6,679,379 B1 * 1/2004 Kao ..... 206/349
6,679,391 B1 * 1/2004 Huang ..... 211/70.6

* cited by examiner

*Primary Examiner*—Shian T. Luong
(74) *Attorney, Agent, or Firm*—William E. Pelton, Esq.

(57) ABSTRACT

A tool suspension device for pliers has a suspension board and a bracket. The suspension board has a front, a rear, a clip and a removable locking stub. The clip is mounted on the rear of the suspension board. The removable locking stub is attached to the front of the suspension board. The bracket is mounted on the front of the suspension board and has a U-shaped frame and clamping arms inside the frame. A tool slot is defined vertically through the frame and is adapted to hold a tool that is positioned head down. The removable locking stub prevents upward movement of the tool to prevent the tool from being easily pulled out of the tool slot to steal. The clip is used to hang the tool suspension device on a person's belt. Therefore, the tool suspension device is burglarproof and double-duty.

10 Claims, 7 Drawing Sheets

TOOL SUSPENSION DEVICE WITH A BURGLARPROOF FEATURE

BACKGROUND OF THE INVENTION

1. Field of the Invention

The present invention relates to a tool suspension device, and more particularly to a tool suspension device with a burglarproof feature for a tool that prevents the tool on the tool suspension device on exhibition from being stolen.

2. Description of Related Art

Pliers, cutters or the like are used to grip small objects and bend or cut things, such as wire. A pair of pliers generally comprises two handles pivotally connected, jaws and a wire cutter. The jaws are used to clamp, and the wire cutter is used to cut wire. Tool suspension devices are used to hold tools, such as pliers in position for display and are hung on a display stand. Visitors and consumers will easily and conveniently see and check operation of the pliers to select a pair of proper pliers for themselves.

With reference to FIG. 7, a conventional tool suspension device for pliers comprises a suspension board (60) and a bracket (64). The suspension board (60) has a front (not numbered), a top (not numbered), a bottom (not numbered) and two opposite sides (not numbered). A hanging hole (61) is defined through the suspension board (60) near the top, and the suspension board (60) is hung on a display stand (not shown). A hinge (631) and a latch (632) with a hook (not numbered) are attached to the front of the suspension board (60) respectively at opposite sides near the bottom. A central holder (62) is formed on the front of the suspension board (60) between the hinge (631) and the latch (632). The hinge (631), the latch (632) and the central holder (62) respectively have transverse slots (not numbered).

The bracket (64) is pivotally connected to the hinge (631) in front of the suspension board (60). The bracket (64) has a top (not numbered), a bottom (not numbered), a front (not numbered), a rear (not numbered) and two opposite sides (not numbered). Two tool slots (641) are respectively defined through the bracket (64) from the top to the bottom. The tool slots (641) are adapted to respectively hold two handles of a pair of pliers (not shown). Vertical stabilizers (642) corresponding to the slots in the hinge (631), the latch (632) and the central holder (62) protrude from the rear of the bracket (64).

When the bracket (64) is pivoted toward the front of the suspension board (60), each of the vertical stabilizers (642) respectively fit into and are held in the slots in the hinge (631), the latch (632) and the central holder (62). The hook on the latch (632) locks and holds the bracket (64) across the front of the suspension board (60). Thereafter, the two handles of the pliers will be respectively held in the tool slots (641).

To keep the handles of the pliers from being inadvertently damaged, a shield (65) is formed from the bottom of the front of the bracket (64) to protect the pliers. Therefore, the pliers are held on the front of the suspension board (60) that is hung on a display stand (not shown). The shield (65) covers the handles of the pliers to prevent the handles from being damaged.

However, the conventional tool suspension device has the following shortcomings.

1. The tool suspended on the conventional tool suspension device is easily stolen.

Since many people see tools on display in public places such as stores and exhibitions and many kinds of tools are on display, a good opportunity exists for shoplifters to steal some of the tools. Pliers displayed in the conventional tool suspension device are really easy to remove from the tool slots (641) in the bracket (64) and steal.

2. The conventional tool suspension device is a disposable item and is not environmentally friendly.

Generally, workers use tool pouches suspended from belts around workers' waists to hold tools for convenient access. The conventional tool suspension device does not have any means to hang the tool suspension device on workers' belts. When a person brings the pliers home, the tool suspension device is thrown away, and the tool is stored in a tool pouch that can be hung on a person's belt. The conventional tool suspension device is not double-duty and is disposable. So, the conventional tool suspension device ultimately pollutes the environment.

To overcome the shortcomings, the present invention provides a tool suspension device with a burglarproof feature for pliers to mitigate or obviate the aforementioned problems.

SUMMARY OF THE INVENTION

The main objective of the invention is to provide a tool suspension device with a burglarproof feature for pliers on exhibit.

Another objective of the invention is to provide a reusable tool suspension device for pliers that can be hung on a person's belt to provide convenient access to a tool in the tool suspension device for the person when the person is working and moving.

Other objectives, advantages and novel features of the invention will become more apparent from the following detailed description when taken in conjunction with the accompanying drawings.

DETAILED DESCRIPTION OF PREFERRED EMBODIMENT

Figure 1:
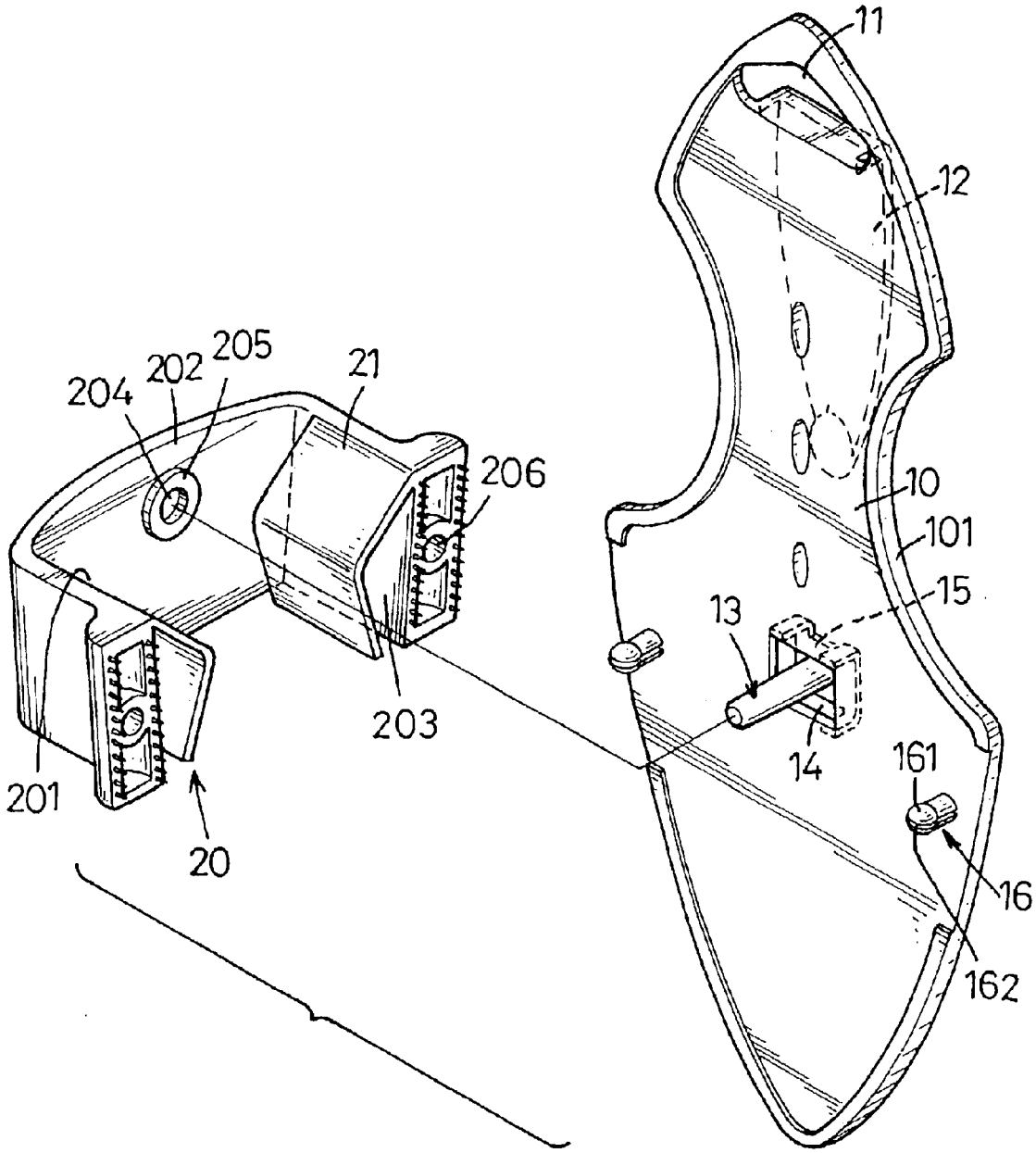
FIG. 1 is an exploded, perspective view of a tool suspension device with a burglarproof feature for pliers in accordance with the present invention.
Figure 2:
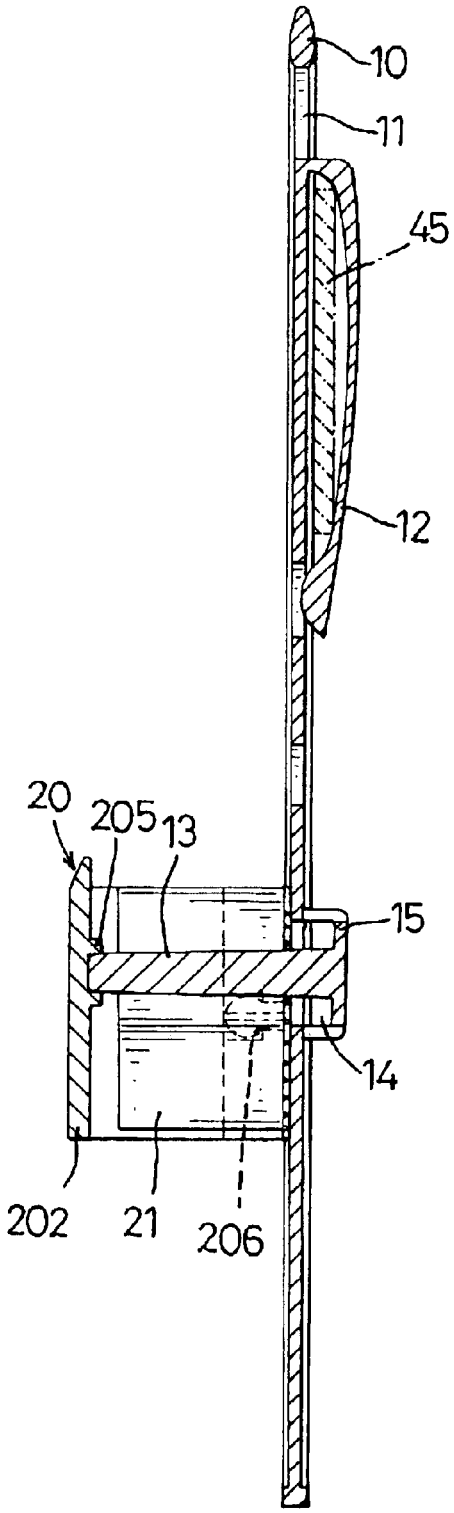
FIG. 2 is a cross sectional side plan view of the tool suspension device in FIG. 1.
Figure 4:
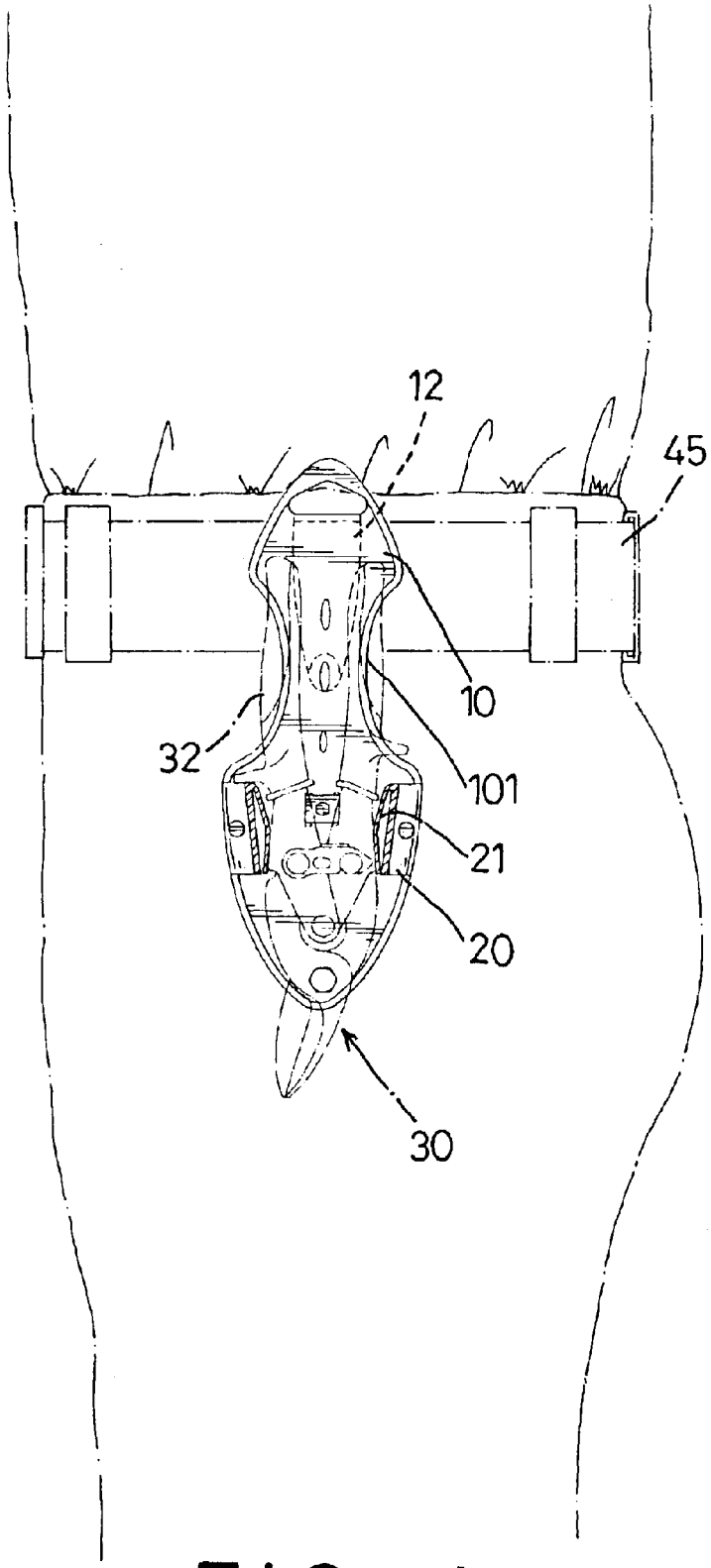
FIG. 4 is an operational front plan view of the tool suspension device in FIG. 3 hung on a person's belt.

With reference to FIGS. 1, 2 and 4, a first embodiment of a tool suspension device in accordance with the present invention comprises a suspension board (10) and a bracket (20). The suspension board (10) has a front (not numbered), a rear (not numbered), a right side (not numbered), a left side (not numbered), a top (not numbered), a bottom (not numbered), a hanging hole (11), a clip (12), two resilient mounting stubs (16), a central opening (14), a locking stub holder (15) and a removable locking stub (13). The suspension board (10) is elongated and has a modified hourglass shape with a recess (101) defined on the right and the left sides of the suspension board (10). The hanging hole (11) is defined through the front of the suspension board (10) near the top and is used to hang the tool suspension device on a display stand (not shown). The clip (12) is attached to the rear of the suspension board (10) below and adjacent to the hanging hole (11). The clip (12) allows the tool suspension device to be clipped to and hung on a person's belt (45).

The two resilient mounting stubs (16) protrude from the front of the suspension board (10) at the left and the right side respectively. Each resilient mounting stub (16) is split and has an enlarged spherical head (161) and a longitudinal compression slot (162). The longitudinal compression slot (162) splits the enlarged spherical head (161) and the mounting stub (16) into halves (not numbered) and allows the halves of the enlarged spherical head (161) to be squeezed together to reduce the size of the enlarged spherical head (161). The central opening (14) is defined through the front of the suspension board (10) between the two resilient mounting stubs (16). The locking stub holder (15) has a front (not numbered) and is attached to the rear of the suspension board (10) corresponding to the central opening (14). The front of the locking stub holder (15) faces the central opening (14). The removable locking stub (13) has a front end (not numbered) and a rear end (not numbered) and passes through the central opening (14), and the rear end of the removable locking stub (13) is attached to the front of the locking stub holder (15). The front end of the removable locking stub (13) extends out of the central opening (14). Such a structure allows the removable locking stub (13) to be broken off and removed so the tool suspension device can be used as a tool carrier.

Figure 3:
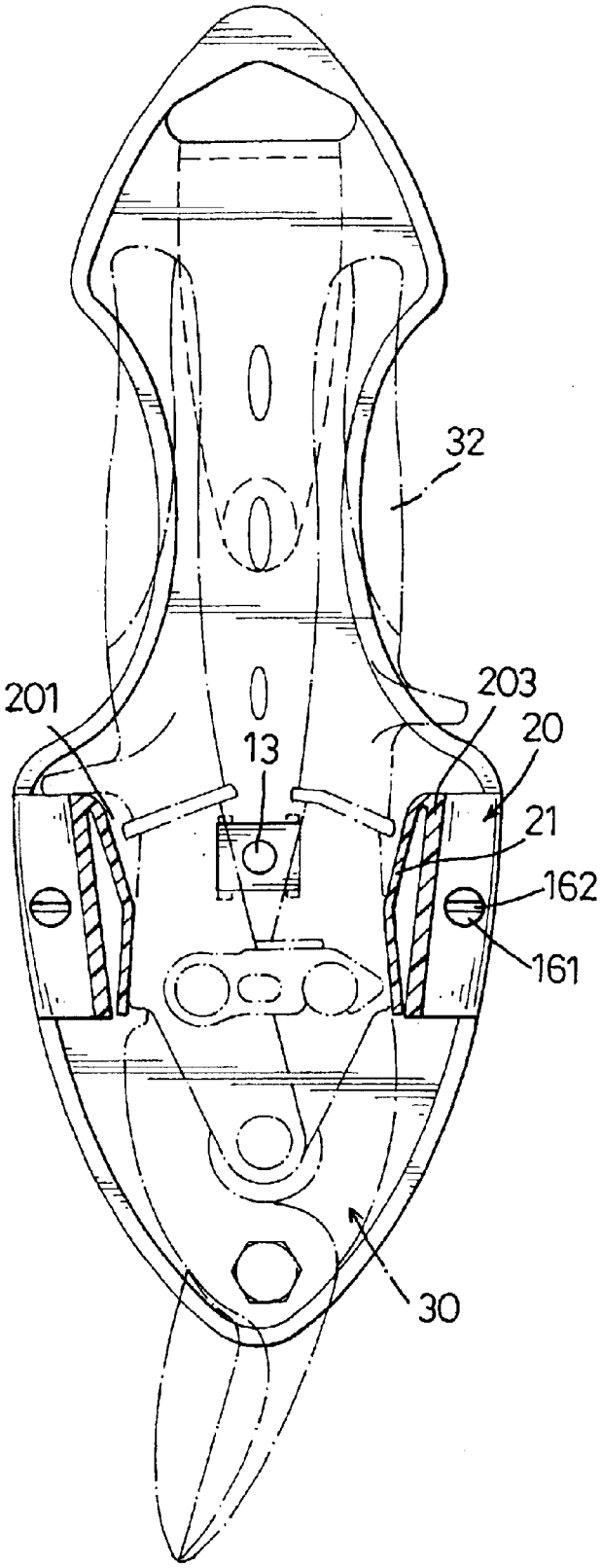
FIG. 3 is an operational cross sectional front plan view of the tool suspension device in FIG. 1 with a pair of pruning cutters in the device.

With reference to FIGS. 1 and 3, the bracket (20) is attached to the front of the suspension board (10) to hold a pair of the pliers or the like, such as a pair of pruning cutters (30), on the front of the suspension board (10). The bracket (20) comprises a U-shaped frame (not numbered) and two resilient clamping arms (21). The U-shaped frame has a front (not numbered), a rear (not numbered), a top (not numbered), a bottom (not numbered), two opposite sides (not numbered), two mounting feet (not numbered), a tool slot (201), a locking recess (204) and an annular shoulder (205). The tool slot (201) is defined vertically from the top to the bottom and inside of the U-shaped frame of the bracket (20). The tool slot (201) has a front wall (202) and two sidewalls (203). The front wall (202) and the sidewalls (203) have an inner surface (not numbered). The locking recess (204) is defined in the front wall (202) and corresponds to and securely holds the front end of the removable locking stub (13). The annular shoulder (205) is mounted around the locking recess (204) and protrudes from the inner surface of the front wall (202) to strengthen the locking recess (204). A mounting foot is formed on each sidewall (203) of the U-shaped frame to abut the front of the suspension board (10), and a mounting hole (206) is defined through each mounting foot. The mounting holes (206) correspond respectively to the resilient mounting stubs (16) on the suspension board (10). Each mounting foot has a contact area (not numbered) that abuts the front of the suspension board (10).

Each resilient clamping arm (21) is V-shaped and has a top end (not numbered) and a bottom end (not numbered). The top end of each resilient clamping arm (21) is attached to the inner surface of each sidewall (203) at the top of the U-shaped frame. The bottom end of each resilient clamping arm (21) faces toward the bottom of the U-shaped frame of the bracket (20). The two resilient clamping arms (21) face each other to tightly hold a tool, such as pliers or the like.

With reference to FIGS. 3 and 4, the resilient clamping arm (21) on the inner surface of each sidewall (203) will clamp the pruning cutters (30) in position, and the locking stub (13) will lock the pruning cutters (30) in the bracket (20). The pruning cutters (30) have a front (not numbered), a rear (not numbered), two handles (32) and two cutting blades (not numbered). The handles (32) are pivotally joined together at a pivot point with the cutting blades (not numbered) at the front of the pruning cutters (30). The cutting blades of the pruning cutters (30) are pressed into the bracket (20) and compress the clamping arms (21) until the pivot pin of the pruning cutter (30) is below the locking recess (204) so the removable locking stub (13) can pass between the handles (32). The bracket (20) and the pruning cutters (30) are attached to the front of the suspension board (10) by aligning the mounting stubs (16) with the mounting holes (206) and the removable locking stub (13) with the locking recess (204) and pressing the enlarged spherical head (161) of each mounting stub (16) through the corresponding mounting hole (206). Since the enlarged spherical heads (161) of the mounting stubs (16) extend out of the mounting holes (206) in the mounting feet of the U-shaped frame of the bracket (20), the enlarged spherical head (161) expands and engages the mounting hole (206) to hold the bracket (20) on the suspension board (10). Therefore, the bracket (20) is securely attached to the front of the suspension board (10).

Figure 5:
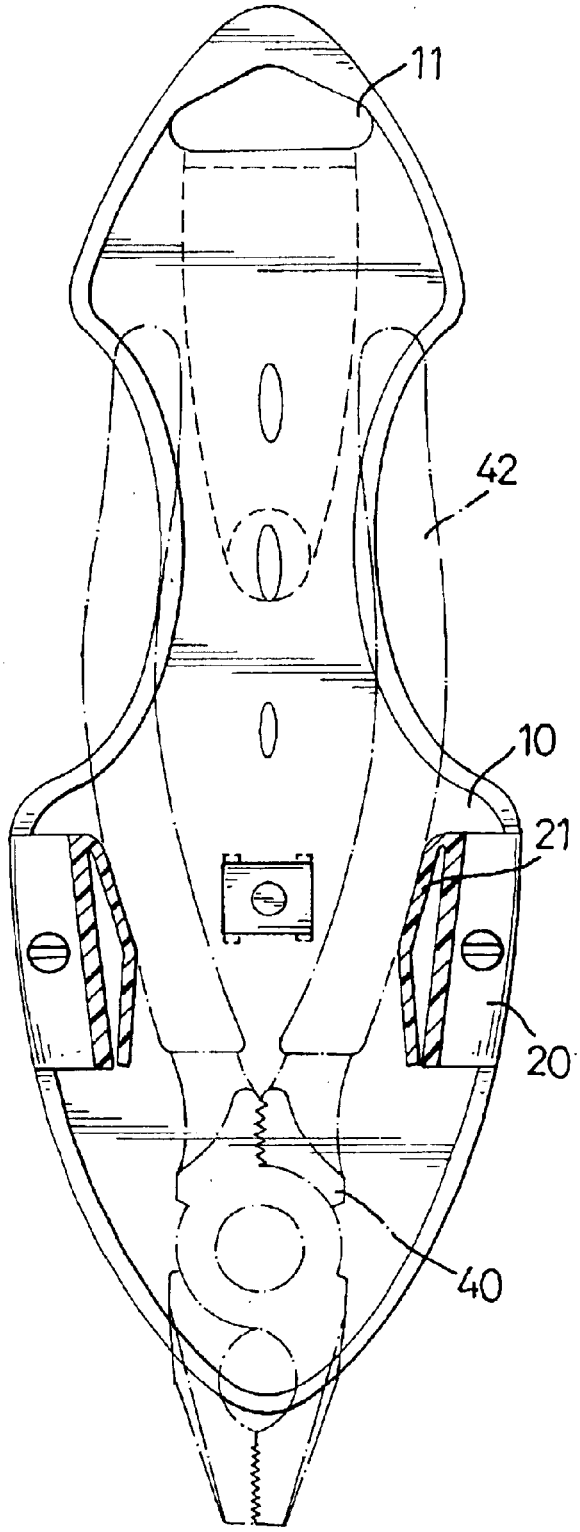
FIG. 5 is an operational cross sectional front plan view of the tool suspension device in FIG. 1 with a pair of side cutter pliers in the device.

With further reference to FIG. 2, the front end of the removable locking stub (13) is held simultaneously in the locking recess (204) on the front wall (202) of the tool slot (201). Because the front and the rear ends of the removable locking stub (13) are respectively held, the removable locking stub (13) is not easily broken. Furthermore, the resilient clamping arms (21) are deformed by the handles (32) of the pruning cutters (30), and the deformation of each resilient clamping arm (21) creates a restitution force that securely clamps the pruning cutters (30). Even though handles of pliers are various sizes and shapes, the V-shaped resilient clamping arms (21) will be accommodated virtually any handles of a pair of pliers. With reference to FIG. 5, a pair of combination pliers (40) is held in the tool suspension device.

Figure 6:
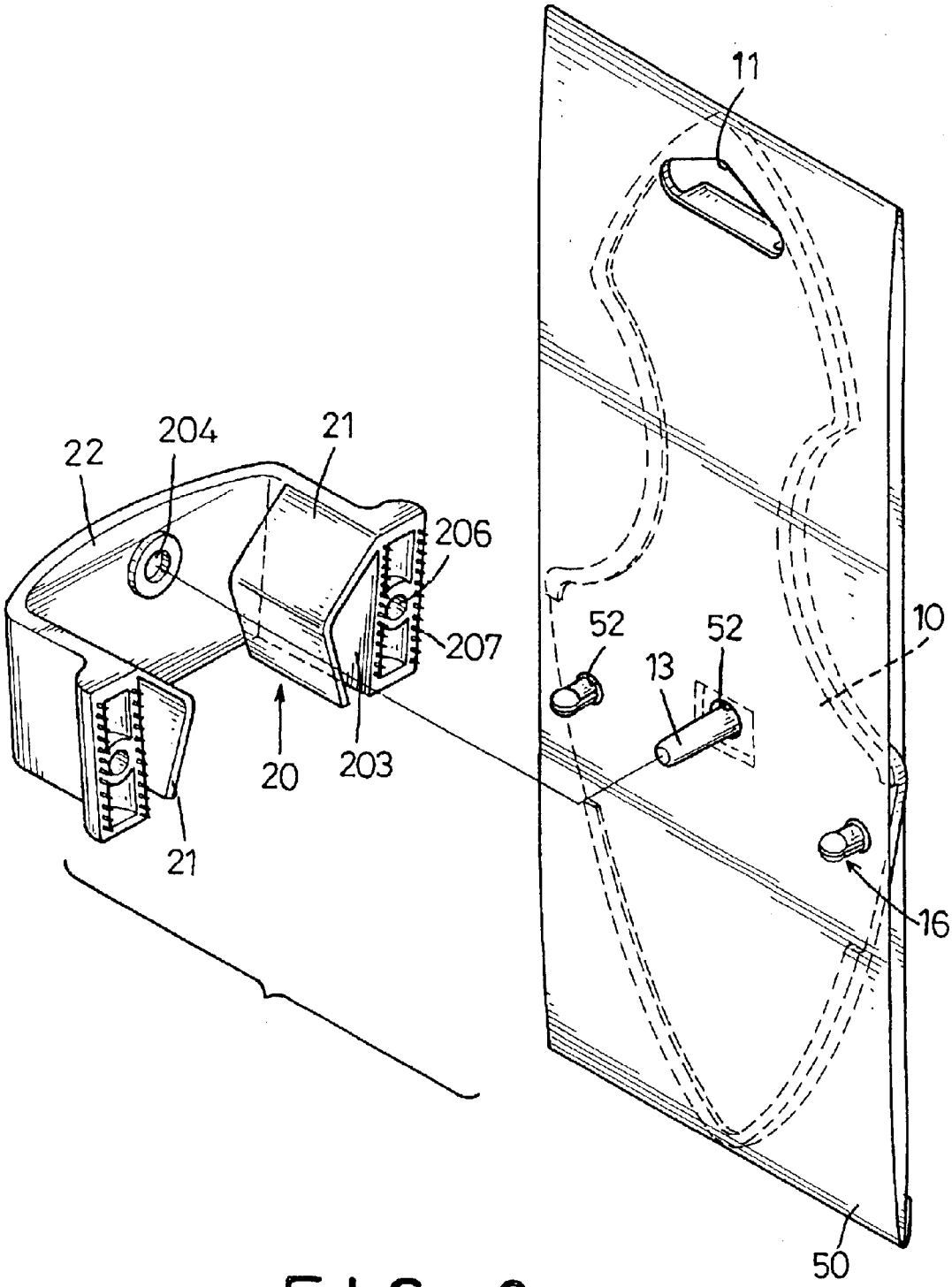
FIG. 6 is an perspective view of an alternative embodiment of the tool suspension device in accordance with the present invention.
Figure 7:
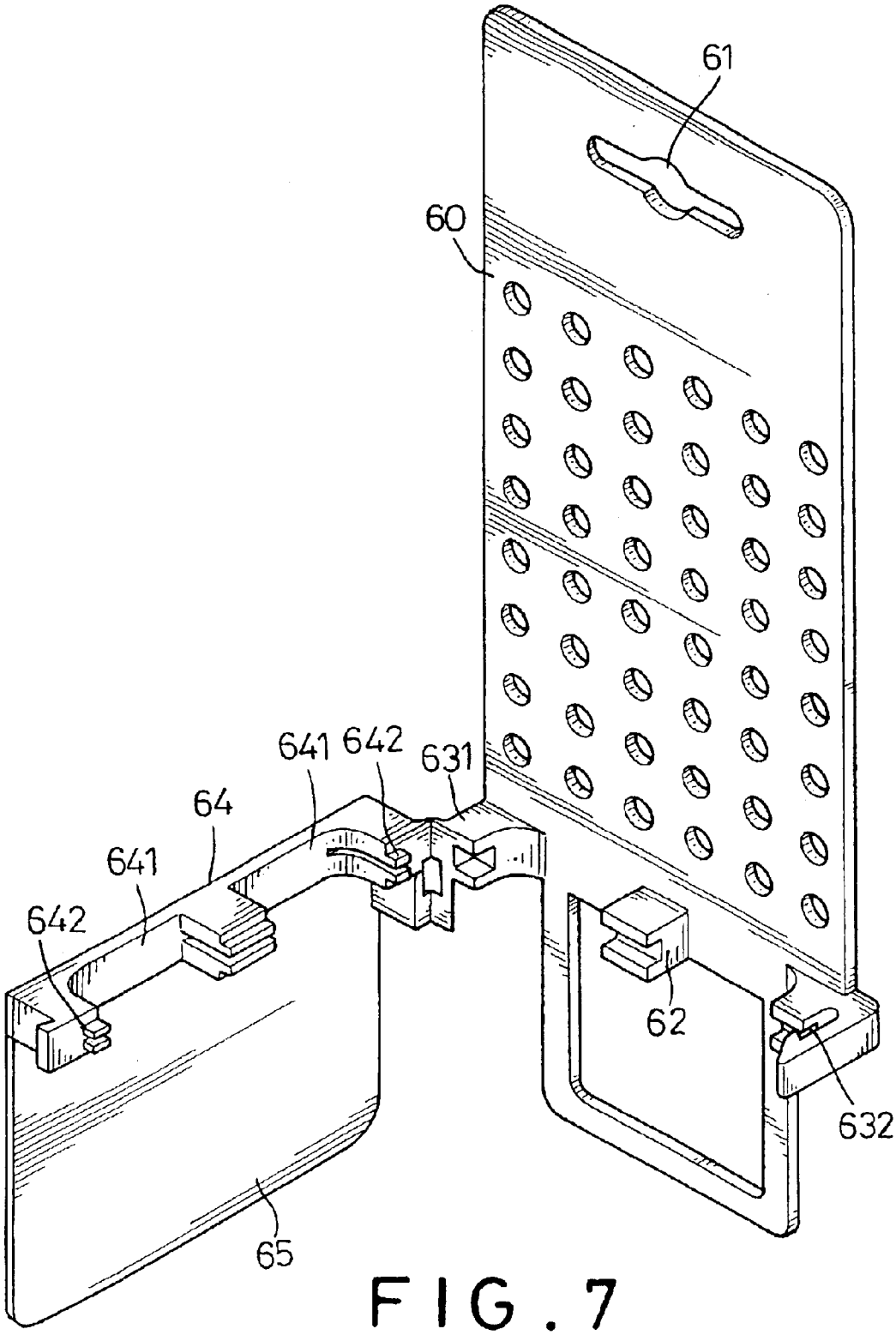
FIG. 7 PRIOR ART
FIG. 7 is an exploded perspective view of a conventional tool suspension device for pliers in accordance with the prior art.

With reference to FIG. 6, a second embodiment of the tool suspension device in accordance with the present invention comprises all the disclosed features of the first embodiment and further comprises a package (50) and multiple spines (207) on the mounting feet on the U-shaped frame of the bracket (20). The package (50) is hollow, is made of paper or the like, has three circular through holes (52) and two hanging through holes (not numbered) and is mounted around the suspension board (10). The circular through holes (52) correspond respectively to the removable locking stub (13) and the resilient mounting stubs (16) on the front of the suspension board (10). The removable locking stub (13) and the resilient mounting stubs (16) respectively pass through and extend out of the circular through holes (52) in the package (50) to be attached to the bracket (20). The hanging through holes correspond respectively to the hanging hole (11) on the front and rear of the suspension board (10). Trademarks, operating instructions, tool specifications, etc. can be printed on the paper or the like. The paper package (50) is easily torn off of the suspension board (10).

The multiple spines (207) are formed on the contact area of each mounting feet of the U-shaped frame of the bracket (20) and reduce area in direct contact with the suspension board (10) and allow any residual paper between the bracket (20) and the suspension board (10) to be easily removed after the package (50) is torn off.

As described, the tool suspension device is not only burglarproof but also reusable. When a tool is mounted on the tool suspension device, the removable locking stub (13) prevents the tool from being easily removed from the tool suspension device when the tool is being displayed. A person who wants to steal the tool must take the entire suspension device including the tool. The combination of the tool suspension device and the tool is large and bulky such that a pilfered tool will be more noticeable.

After a person buys a tool and takes the tool and the tool suspension device home, the tool is removed from the tool suspension device by removing the removable locking stub (13) and pulling the tool out of the top of the bracket (20). To remove the removable locking stub (13) from the suspension board (10), a person simply cuts the locking stub holder (15) off the rear of the suspension board (10) and pulls the removable locking stub (13) through the central opening (14) in the suspension board (10). Because the tool suspension device has a clip (12) on the rear of the suspension board (10), the tool suspension device can be clipped to a person's belt and used to carry a tool such as a pair of pliers or the like. In short, the tool suspension device is reusable.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension device with a burglarproof feature for a tool having two handles pivotally connected at a pivot pin, and the tool suspension device comprising:

a suspension board with a front, a rear, a right side, a left side, a top and a bottom and having a hanging hole defined through the front near the top of the suspension board and adapted to hang the tool suspension device on a display stand;

a clip attached to the rear of the suspension board below and adjacent to the hanging hole and adapted to clip on a person's belt;

two resilient mounting stubs attached to the front of the suspension board, each of the resilient mounting stubs having an enlarged head;

a locking stub holder mounted on the suspension board; and a removable locking stub attached to the locking stub holder and having a front end; and a bracket mounted on the front of the suspension board by means of the resilient mounting stubs and having a U-shaped frame with a front, a rear, a top, a bottom and two opposite sides;

a tool slot defined through the top to the bottom between the two sides of the U-shaped frame and having a front wall and two sidewalls, each of the front wall and the two sidewalls having an inner surface;

a mounting foot formed on each sidewall of the U-shaped frame to abut the front of the suspension board and having a mounting hole and a contact area, the mounting hole defined through each mounting foot corresponding to one resilient mounting stub on the suspension board and the contact area abutting the front of the suspension board; and a locking recess defined through the front wall and corresponding to the front end of the removable locking stub in the suspension board to hold the front end of the removable locking stub;

wherein the enlarged head of each resilient mounting stub is deformed to pass through the mounting hole of the mounting foot and extends out of the mounting hole so as to hold the bracket at the front of the suspension board in position.

2. The tool suspension device as claimed in claim 1, wherein the bracket further comprises a V-shaped resilient clamping arm secured on the inner surface of each sidewall of the tool slot, each resilient clamping arm having a top end and a bottom end, the top end of each resilient clamping arm secured on the inner surface of one of the sidewalls at the top of the U-shaped frame of the bracket and the bottom end of each resilient clamping arm extending toward the bottom of the U-shaped frame of the bracket, where the two resilient clamping arms are positioned corresponding to each other to be adapted to tightly hold a tool.

3. The tool suspension device claimed in claim 2, wherein the suspension board further has comprises a central opening defined through the front of the suspension board between the two resilient mounting stubs; and the locking stub holder having a front attached to the rear of the suspension board and corresponding to the central opening, the front of the locking stub holder facing the central opening;

wherein the removable locking stub is attached to the front of the locking stub holder and is held in the central opening, and the front end of the removable locking stub extends out of the central opening.

4. The tool suspension device as claimed in claim 3, further comprising a hollow package having three circular through holes and two hanging through hole mounted around the suspension board, the three circular through holes respectively corresponding to the removable locking stub and the resilient mounting stubs in the front of the suspension board and the hanging through holes corresponding to the hanging hole in the suspension board; and multiple spines formed on the contact area of each mounting foot of the U-shaped frame of the bracket to abut the suspension board;

wherein the removable locking stub and the resilient mounting stubs respectively pass through and extend out of the through holes in the package to be attached to the U-shaped frame of the bracket.

5. The tool suspension device as claimed in claim 4, wherein the enlarged head of each resilient mounting stub is spherical and a compression slot is defined through the enlarged head to the front of the suspension board to split the enlarged spherical head and the mounting stub into two halves.

6. The tool suspension device as claimed in claim 5, wherein the U-shaped frame has an annular shoulder protruding from the inner surface around the locking recess of the front wall of the U-shaped frame; and the suspension board further has an hourglass shape with a recess defined at each of the right and the left sides of the suspension board.

7. The tool suspension device as claimed in claim 1, wherein the suspension board further comprises a central opening defined through the front of the suspension board between the two resilient mounting stubs; and locking stub holder having a front attached to the rear of the suspension board and corresponding to the central opening and the front of the locking stub holder facing the central opening;

wherein the removable locking stub is attached to the front of the locking stub holder and is held in the central opening, and the front end of the removable locking stub extends out of the central opening.

8. The tool suspension device as claimed in claim 1 further comprises a hollow package having three circular through holes and two hanging through holes mounted around the suspension board, the three circular through holes respectively corresponding to the removable locking stub and the resilient mounting stubs on the front of the suspension board and the hanging through holes corresponding to the hanging hole in the suspension board; and multiple spines formed on the contact area of each mounting foot of the U-shaped frame of the bracket to abut the suspension board;

wherein the removable locking stub and the resilient mounting stubs respectively pass through and extend out of the circular through holes in the package to be attached to the U-shaped frame of the bracket.

9. The tool suspension device as claimed in claim 1, wherein the enlarged head of each resilient mounting stub is spherical and a compression slot is defined through the enlarged head to the front of the suspension board to split the enlarged spherical head and the mounting stub into two halves.

10. The tool suspension device as claimed in claim 1, wherein the U-shaped frame further has an annular shoulder protruding from the inner surface around the locking recess of the front wall of the U-shaped frame; and the suspension board further has a substantially hourglass shape with a recess defined at each of its right and the left sides.

* * * * *